United States Patent [19]

Kuroda et al.

[11] 4,405,686

[45] Sep. 20, 1983

[54] CRIMPABLE CONJUGATE FILAMENTARY YARNS HAVING A FLATTENED CROSS-SECTIONAL CONFIGURATION

[75] Inventors: Toshimasa Kuroda, Takatsuki; Seiji Ishii, Matsuyama; Tatsuya Shibata, Ibaraki, all of Japan

[73] Assignee: Teijin Limited, Osaka, Japan

[21] Appl. No.: 385,942

[22] Filed: Jun. 7, 1982

[30] Foreign Application Priority Data

Jun. 5, 1981 [JP] Japan ..... 56-85611

[51] Int. Cl.[3] ..... B32B 27/02; D02G 3/02

[52] U.S. Cl. ..... 428/374; 264/177 F; 428/370; 428/397; 428/401

[58] Field of Search ..... 428/374, 397, 401, 370

[56] References Cited

U.S. PATENT DOCUMENTS

| | | | |
|---|---|---|---|
| 2,932,079 | 4/1960 | Dietzseh et al. | 428/397 |
| 3,109,220 | 11/1963 | McKinney et al. | 428/397 |
| 3,117,906 | 1/1964 | Tanner | 428/397 |
| 3,156,607 | 11/1964 | Straehan | 428/397 |
| 3,547,763 | 12/1970 | Hoffman | 428/397 |
| 3,914,488 | 10/1975 | Gorrafa | 428/397 |
| 4,002,795 | 1/1977 | Barbe et al. | 428/397 |
| 4,106,313 | 8/1978 | Boe et al. | 66/22 |
| 4,118,534 | 10/1978 | Stanley | 428/397 |
| 4,248,934 | 2/1981 | Wandel et al. | 428/374 |

*Primary Examiner*—James C. Cannon

*Attorney, Agent, or Firm*—Sughrue, Mion, Zinn, Macpeak and Seas

[57] ABSTRACT

A conjugate filamentary yarn, which is prepared from composite components respectively comprising thermoplastic elastomer and non-elastomeric polyamide or polyester, and each of the individual constituents has a cross section of a compressed flat shape like a cocoon or oval, is provided. Hereby, a highly stretchable crimped elastic yarn, in which stretchability arising from crimp and rubber-like elasticity resulting from elastomer are utilized to the utmost, is made available with economy.

12 Claims, 13 Drawing Figures

CRIMPABLE CONJUGATE FILAMENTARY YARNS HAVING A FLATTENED CROSS-SECTIONAL CONFIGURATION

BACKGROUND OF THE INVENTION

The present invention relates to conjugate filamentary yarns consisting of thermoplastic elastomer and non-elastomeric polyamide or polyester, wherein the structural arrangement of the conjugate components makes both their respective stretchability resulting from fine crimp and elasticity of elastomer itself available for obtaining conjugate filamentary yarn.

DESCRIPTION OF THE PRIOR ART

It has hitherto been generally known that conjugate filamentary yarns prepared by conjugating two polymers having dissimilar heat shrinkage characteristics in a side-by-side or eccentric sheath-core arrangement have latent crimpability. Of them all, those conjugate filamentary yarns which are composed of elastomeric polyurethane elastomer as one component and non-elastomeric polyamide as other component (disclosed in the specification of U.S. Pat. No. 4,106,313 and in the gazette of Japanese Patent Publication No. 27175/80) are used in the line of textile product where crimpability is required as in a case of panty hose and the like because of their excellent stretchability arising from their fine and numerous crimps. However, these conjugate filamentary yarns prepared by use of polyurethane elastomer are advantageous in that polyurethane elastomer helps the yarns to form fine crimp making the best use of its higher heat-shrinkability but its property of elasticity (rubber-like elasticity) is scarcely utilized.

On the other hand, polyurethane filamentary yarn has such a high elongation as 400 to 500% when measured in terms of rubber-like extension. This makes it difficult to use a yarn of such high elasticity, therefore it is necessary to control its high elongation to 200 to 300%. As the method to achieve this object, a so-called covered yarn, which is prepared by winding a crimped yarn or flat yarn around the urethane elastic yarn singly or doubly, is used. However, a covered yarn of this type is practically used only for special purposes, because of its high cost arising from a fact that the urethane elastic yarn is obtained by the wet spinning method or the dry spinning method which is less productive than the melt spinning method and also the covering process adds to its cost. Also such covered yarn like this has a demerit that it lacks in the bulkiness inherent in a crimped yarn.

SUMMARY OF THE INVENTION

The object of this invention is to provide a crimped stretch yarn having a property of rubber-like elasticity inherent in elastomer in addition to the crimp bulkiness and stretchability produced by conjugating elastomeric thermoplastic elastomer and non-elastomeric polyamide or polyester in a specific conjugate arrangement.

The abovementioned object can be achieved by a conjugate filamentary yarn, characterized in that each of the individual constituents whose cross-sectional view presents a compressed flat figure, comprises an elastomeric thermoplastic elastomer and a non-elastomeric polyamide or a polyester, wherein the respective components are arranged spun in such a way as to satisfy the following formulas (I) to (III) simultaneously:

$$4 \geqq \frac{b}{a} \geqq 1.2 \quad \text{(I)}$$

$$2.3 \geqq \frac{EA}{PA} \geqq 0.43 \quad \text{(II)}$$

$$\overline{EiPi} \geqq \frac{a}{2} \quad \text{(III)}$$

where a indicates the length of the minor axis which passes the centroid on the cross section of the filament; b, the length of the major axis which passes the centroid on the cross section of the filament; EA, the area occupied by elastomer on the cross section of the filament; PA, the area occupied by non-elastomeric polyamide or polyester on the cross section of the filament; and $\overline{EiPi}$, the distance between the centroid Ei of the elastomer component on the cross section of the filament and the centroid Pi of the non-elastomeric polyamide or polyester component respectively.

DESCRIPTION OF THE PREFERRED EMBODIMENTS

The inventors of the present invention have conducted an intensive and extensive study on conjugate stretch yarns comprising thermoplastic elastomer and non-elastomeric polyamide or polyester in search of a structure of the conjugate stretch yarn in which stretchability resulting from crimp and rubber-like elasticity arising from elastomer are in best structural combination to produce the highest degree of stretchability. The study has resulted in the finding of a fact that a structure of the conjugate stretch yarn becomes most desirable when the filament is made to have a cross-sectional view of a compressed flat figure like a cocoon or an oval, in which the two components are conjugated together in such a way as to have their respective centroids on the major axis.

The present invention will be explained in detail referring to the accompanying drawings. In FIGS. 1 to 11, i indicates the centroid on the cross section of the filament; a, the length of the minor axis which passes the centroid i on the cross section of the filament; b, the length of the major axis which passes the centroid i on the cross section of the filament; E, the elastomer component; P, the non-elastomeric polyamide or polyester component; Ei, the centroid of the elastomer component on the cross section of the filament; and Pi, the centroid of the polyamide or polyester component on the cross section of the filament respectively.

Figure 1:
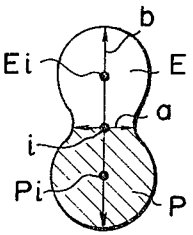
FIGS. 1–3 illustrate typical cross sections of the filaments of the present invention.
Figure 2:
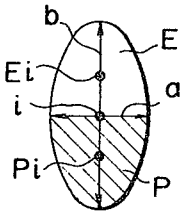
Figure 3:
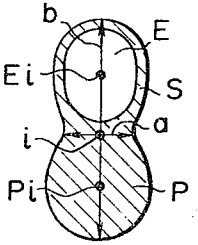
Figure 7:
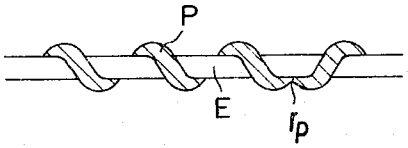
Figure 6:
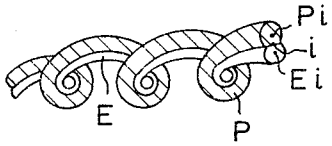

The filament proposed in the present invention have a compressed flat figure like a cocoon or an oval in their cross section as shown in FIGS. 1–3. In setting up such form, the filament has two components conjugated to each other, i.e., a component E comprising thermoplastic elastomer and a component P comprising non-elastomeric polyamide or polyester, each having its centroid located on the major axis on its cross section. In other words, the two components are structurally conjugated together to hold the minor axis in common as their contact surface. When such a filament is made to develop crimp, it takes the form of a three-dimensional spiral crimp with the component E located inside the spiral and the component P outside the spiral as shown in FIG. 6. As the filament is being stretched, the component E is stretched straight, while the component P comes to take the form of a helical thread of a wood screw and surround the component E forming a certain angle and accordingly the filament itself exhibits a structure of a screw as shown in FIG. 7. The exhibition of such a structure is attributable to a fact that the centroid Ei of the elastomer component is far away from the centroid i on the cross section of the filament on the major axis and the component E can shrink much more than the component P because the component E has a greater value in terms of the physical construction of elastisity as well as the heat-shrinkage greater than the component P.

When the filament exhibiting the structure of a screw is further stretched, it can be stretched as far as it takes the form shown by 8.

Figure 8:
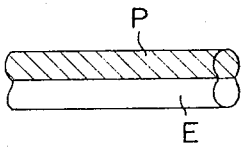
FIGS. 6–8 represent a series of lateral views of a short segment of the filaments of the present invention to show its physical behavior at different degrees of stretch.

Therefore, it may be said that at the stage in which the state of the filament shown in FIG. 6, shifts to the state of FIG. 7, the crimp stretchability is dominant; while at the stage in which the state of the filament shown in FIG. 7 shifts to the state of FIG. 8, the rubber-like elasticity is dominant.

Figure 4:
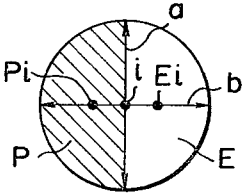
FIGS. 4 and 5 show cross sections of conventional conjugate filaments.
Figure 5:
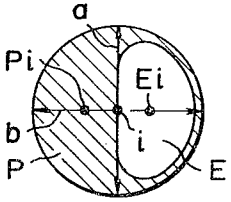

The addition of this rubber-like elastic property to the conjugate filamentary yarn is a most remarkably characteristic of the present invention and this property can never be made available for conventional conjugate filamentary yarns in which each of the individual constituents presents a circular like those shown in FIGS. 4 and 5.

Figure 11:
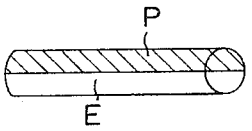
FIGS. 9–11 represent similar lateral view of the conventional conjugate filaments.
Figure 10:
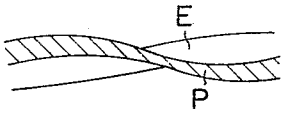
Figure 9:
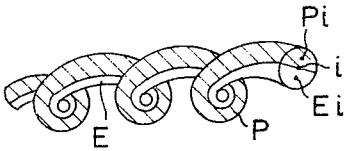

A conjugate stretch filament which has a cross section as shown in FIGS. 4 and 5 varies its shape in the order of FIGS. 9, 10 and 11 as the degree of stretch increases. A stretch filament of this type has the form of a three-dimensional spiral crimp with the component E located inside the spiral and the component P outside the spiral as shown in FIG. 9, quite similar to the one shown in FIG. 6.

When this crimped stretch filament is stretched, it directly takes the form shown in FIG. 10, without taking the form of a screw which can be realized by the conjugate stretch filament of the present invention in FIG. 7. Therefore, the filament can simply make use of crimp stretchability which is dominant only at the stage in which the state of the filament shown in FIG. 9, shifts to the state of FIG. 10. The filament accordingly can make no use of rubber-like elasticity which arises from its screw structure occurring at the stage in which the state of the filament shown in FIG. 9, shifts to the state of FIG. 11, in stepwise stretching.

Therefore, the crimped stretch yarn of high stretchability which can make the most of both stretchability arising from crimp and rubber-like elasticity resulting from elastomer should necessarily be a conjugate filamentary yarn in which each of the individual constituents takes the form of a screw structure shown in FIG. 7.

It is essential for a conjugate filament which takes the form of a screw structure to simultaneously satisfy both relationships of $(a/b) \geqq 1.2$ and $\overline{EiPi} \geqq a/2$, where a indicates the length of the minor axis which passes the centroid i on the cross section of the filament; b, the length of the major axis which passes the centroid i on the cross section of the filament; and $\overline{EiPi}$, the distance between the centroid Ei of the elastomer component on the cross section of the filament and the centroid Pi of the non-elastomeric polyamide or polyester component respectively. When the centroid Ei of the elastomer component shifts too close to the centroid i on the cross section of the filament and results in $(b/a) < 1.2$ and $\overline{EiPi} < (a/2)$, the shrinking point of the component E comprising elastomer comes too close to the centroid i on the cross section of the filament and accordingly enough shrinkage can not be caused to make the filament form a screw structure.

It will be easily understood that the efficient making of such a screw structure like the above can be achieved more satisfactorily when the contact surface between the E component of elastomer and the P component of polyamide or polyester is made small and also when the centroid Ei of the elastomer component is far away from the centroid Pi of polyamide or polyester component and centroid i on the cross section of the filament as shown in FIG. 1.

In the present invention it is essentially necessary for the filament to have the relation between a and b which satisfies a formula of $4 \geqq (b/a) \geqq 1.2$ in order to have said screw structure and a cross section of a conjugate filament to be satisfactorily useful as clothing materials. When (b/a) is larger than 4, the cross section of the filament becomes too flat and when it is woven or knitted into a fabric, the fabric has rough harshness which makes the hand or feeling unsatisfactory. Also when the filament is made to form crimp, the resulting crimp coils are too large to make fine crimp and accordingly the stretchability of the obtained crimped stretch yarn is bad. On the other hand, when (b/a) is smaller than 1.2, the stretchability of the crimped filament becomes better but the crimp filament can not form a screw structure as mentioned before and rubber-like elasticity can not be utilized.

Furthermore, in the present invention it is necessary for the filament to have the relation between the area EA of component E on the cross section of the filament and the area PA of component P on the cross section of the filament which satisfies a formula of $2.3 \geqq (EA/PA) \geqq 0.43$. When (EA/PA) is larger than 2.3, the elastomer component becomes too large to lower the color fastness and degrade the physical properties such as strength, elastic stretchability, etc. of the obtained crimped stretch yarn and the woven or knitted fabrics prepared from such crimped stretch yarn are unfit for use. When (EA/PA) is smaller than 0.43, the rubber-like elasticity becomes extremely small and a crimped stretch yarn having both crimp stretchability and rubber-like elasticity according to the present invention can not be obtained. It is most desirable to keep the value of (EA/PA) in the range of 0.67 to 1.5, usually it is to be set at 1.

Next, it is necessary in the present invention to keep the distance $\overline{EiPi}$ between Ei and Pi more than (a/2). More particularly, it means that the centroids Ei and Pi are substantially on the major axis b and that the distance $\overline{EiPi}$ between the two centroids is more than (a/2) which makes the cross section of the filament flat like a cocoon or an oval as shown in FIGS. 1–3 and also makes the centroids of the two components locate on the major axis. Conjugate filaments having such a circular cross section as shown in FIGS. 4 and 5 are not included in the range of claims laid by the present invention. When $\overline{EiPi}$ is smaller than (a/2), the stretability arising from crimp may be developed fully but the aforementioned screw structure can not be obtained. The filament will simply take the form of a crimped filament of conventionally known three-dimensional spiral structure which can make use of its non-elastomeric polymer's property only but no use of rubber-like elasticity of its elastomer component.

It is desirable to have the centroids Ei and Pi of the two components located on the major axis which passes the centroid i. However, Ei and Pi may be located somewhat off the major axis. In this case, an angle between the minor axis which passes i and the straight line $\overline{iEi}$ connecting Ei and i or the straight line $\overline{iPi}$ connecting Pi and i should desirably be kept within the range of $90° \pm 30°$.

The conjugation structure of a filament which has the form of a cross section of the filament like this is effected by conjugating a component E comprising elastomer and a component P comprising non-elastomeric polyamide or polyester in a side-by-side or eccentric sheath-core arrangement.

As thermoplastic elastomer to be used to form an elastic component in the present invention, it is recommendable to use elastomer which is melt spinnable, having a hardness of 90 to 100 when determined according to JIS K-6301. This type of thermoplastic elastomer includes elastomer of polyurethane type and elastomer of polyamide type. The former elastomer of polyurethane type is thermoplastic polyurethane which is obtained by reacting a mixture, which consists essentially of polyester having a terminal hydroxyl group and/or poly (oxyalkylene) glycol having a molecular weight of 1000 to 3000 diisocyanate, and glycol as chain-extending agent, and further addition of polycarbonate having a terminal hydroxyl group as case may be required. As the polyester mentioned above, dibasic acids such as sebacic acid and adipic acid, and diols such as ethylen glycol, butylene glycol, diethylene glycol, etc. are used. As the poly (oxyalkylene) glycol, such block copolymer or homogeneous polymer as poly(oxyethylene)glycol, poly(oxypropylene)glycol, poly(oxybutylene) glycol, etc. can be used. As diisocyanate, 2,4-tolylenediisocyanate, diphenylmethane-4,4'-diisocyanate, dicyclohexyl methane-4,4'-diisocyanate, etc. may be selected. As the chain-extending agent, ethylene glycol, propylene glycol, butylene glycol, and 1,4-$\beta$-hydroxyethoxybenzene can be used. As polycarbonate to be used optionally, a polymer of either bisphenol A and phosgen or bisphenol A and diphenylcarbonate having a terminal hydroxyl group must be used.

As the latter elastomer of polyamide type, a copolymer of polylauryl lactam and dicarboxylic acid of polybutylene glycol (produced from 1,4-butanediol) is generally used. The hardness can be controlled by adjusting the molecular weight of butylene glycol which composes the rubber ingredient or also by changing the copolymerization ratio between polylauryl lactam and rubber ingredient. As polyester which is one of the non-elastomeric components, polyethylene terephthalate, polybutylene terephthalate, polypropylene terephthalate, etc. which has generally the fiber-forming property may be mentioned, of which polyethylene terephthalate and polybutylene terephthalate may be counted as desirable polyester. A copolymer prepared by copolymerizing 5-sodium sulfoisophthalic acid with any of these polyesters is more desirable for the use, because it has good adhesion to elastomer. As polyamide which is another of the non-elastomeric components, nylon 6, nylon 66, nylon 610, nylon 11, nylon 12, nylon 13, etc. may be mentioned and among them, nylon 6 is especially recommendable. In determining the combination of an elastomeric component and a non-elastomeric component, care should be exercised in their selection, taking good compatibility and conjugating adhesiveness of the respective components into consideration so that the conjugated two components will not separate from each other during the stage of melt spinning, drawing, texturing, weaving, and knitting. Especially in case where polyester is used as a non-elastomeric component, it is recommendable to use elastomer of polyester type, for instance, a block copolymer of polyether and polyester as thermoplastic elastomer. Also it is desirable to use polyethylene terephthalate copolymerized with 5-sodium sulfoisophthalic acid as a polyester component since it improves the conjugating adhesiveness. On the other hand, in case where polyamide is used as a non-elastomeric component, it is desirable to use polyurethane of caprolactone type or polycarbonate type, or elastomer of polyamide type, for instance, a copolymer of polylauryl lactam and polyol, as thermoplastic elastomer.

A resistance-to-light improving agent, such as a compound of benzophenone or benzotriazole, or an inorganic manganese compound, or the like, may be added to elastomer and/or polyamide to improve their resistance to light.

By way of example, a method will be cited for obtaining the aforementioned crimped stretch yarn in which both stretchability arising from fine crimp and rubber-like elasticity of elastomer itself are utilized in a conjugate filamentary yarn, wherein the method comprises conjugate melt spinning thermoplastic elastomer and non-elastomeric polyamide or polyester in a side-by-side or eccentric sheath-core arrangement, followed by processes of drawing, heat treatment, and relaxted heat set treatment.

Figure 12:
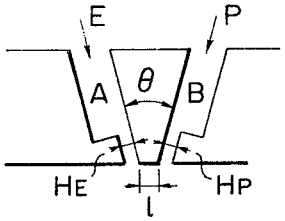

As the spinneret for conjugate melt spinning a filamentary yarn in a side-by-side arrangement in the abovementioned method, a spinneret like one shown in FIG. 12, which is designed to separately extrude the component E consisting of elastomer and the component P consisting of non-elastomeric polyamide or polyester from the respective spinneret holes and conjugate the two components at a point immediately after their extrusion from the spinneret, is recommendable as a proper spinneret. FIG. 12, is a sectional side view of such an example of spinneret. The component E and component P are respectively led to the conduits A and B and extruded from the spinning holes HE and HP. At this time, the aforementioned a/b can be put in a required balance by adjusting the distance l between the spinning holes HE and HP and the angle $\theta$ formed by these two spinning holes. When l is made larger and $\theta$ is made smaller, (b/a) becomes larger. In contrast with this, when l is made smaller and $\theta$ is made larger, (b/a) becomes smaller. In order to satisfy the condition of $4 \geqq (b/a) \geqq 1.2$ stipulated by the present invention, necessary adjustment can be obtained when l is within the range of 0.3 mm to 0.1 mm and $\theta$ is 8° to 30°.

Furthermore, EA and PA can be put in a required balance by adjusting the extrusion rates of the component E and component P respectively by means of a gear pump (not shown in the drawing) equipped to the spinning machine. The area of the spinning holes HE and HP may be designed to meet the desired extrusion rates respectively. To give some reasonable criterion, the condition of $2.3 \geqq EA/PA \geqq 0.43$ provided by the present invention can be satisfied when the linear velocity at the spinning hole is made to be within the range of 5 m/min. to 13 m/min.

The adjustment of $\overline{EiPi}$ varies deponding upon the other two conditions; however, in case where the spinning holes HE and HP are circular, when l is made larger, $\overline{EiPi}$ becomes larger and when $\theta$ is made smaller, $\overline{EiPi}$ also becomes larger as in the case of changing the conditions of (b/a). In another way, the adjustment of EiPi can also be effected by changing the shape of the spinning holes HE and HP. When HE and HP are made triangular and arranged at a distance l, $\overline{EiPi}$ becomes larger than when HE and HP are circular. Contrarily, when they are arranged as shown in FIG. 13, $\overline{EiPi}$ becomes smaller.

Figure 13:
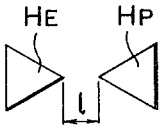
FIGS. 12 and 13 are rough sketches of the spinnerets used for spinning conjugate filaments of this invention.

What we have mentioned with regard to FIGS. 12 and 13 in the above do not set any limitations to the present invention.

In case where the filament is conjugate melt spun in an eccentric sheath-core arrangement, a spinneret described in the gazette of Japanese Patent Publication No. 27175/80 is suited. The conjugate melt spinning in an eccentric sheath-core arrangement makes the elastomer component take its place in the core position and, therefore, is very effective in that it solves the problem of causing cohesion between the elastomer components at the time of take up which causes a difficulty in separating them into individual filaments as seen with the conjugate melt spinning of a filament in a side-by-side arrangement.

In order to make thus obtained conjugate yarn into a crimped stretch yarn in which both stretchability arising from fine crimp and elasticity of elastomer itself are made to be utilized, the desired crimped stretch yarn can be easily obtained by subjecting the conjugate yarn to the drawing, heat treatment followed by the relaxed heat set treatment conducted in the flow of heated fluid. It is desirable to make the crimped stretch yarn obtained after the relaxed heat set treatment show a shrinkage of 22% or less in a boiling-off water treatment. When the crimped stretch yarn shows a shrinkage in excess of 22%, it tends to have inferior weavability and knittability and the fabric prepared therefrom shows unsatisfactory dimensional stability. The shrinkage in the boiling-off water treatment tends to increase when the temperature of heat treatment after drawing is low or the temperature of heated fluid is low; however, it is perfectly possible to make the shrinkage 22% or less in the boiling-off water treatment when the treatment temperatures are kept within the range of heat treatment temperature after drawing and temperature of heated fluid as mentioned hereunder.

It is desirable to keep the temperature of heat treatment after drawing in range of a room temperature up to 120° C. When the temperature of said heat treatment is kept in excess of 120° C., the obtained crimped stretch yarn shows a shrinkage of 22% or less in the boiling-off water treatment. This improves the dimensional stability but reduces the degree of stretchability, thus tending to fail developing desired stretchability resulting from crimp. Incidentally, the drawing is desired to be conducted at ordinary operation temperature ranging from room temperature to 60° C.

It is desirable to keep the temperature of a heated fluid ejected into the jet nozzle within the range of 80° to 150° C. When the temperature of fluid is below 80° C., the shrinkage in the boiling-off water treatment increases, which tends to be undesirable in terms of dimensional stability. On the contrary, when the temperature exceeds 150° C., the shrinkage decreases but it tends to increase the elongation at break, which leads to "tight pick" in a fabric and also to lower the degree of stretchability, making the desired stretchability unobtainable. As the fluid to be used in this treatment, both air and steam are recommendable; however, air is more recommendable since it makes less noise.

As the heated fluid nozzle, nozzles which have hitherto been used for relaxed heat set treatment, such as those disclosed in the gazzete of Japanese Patent Publication No. 37576/70, gazzette of Japanese Utility Model Publication No. 9535/71, and specification of U.S. Pat. No. 4,188,691, can be used. A stretch yarn having fine uniform crimp can be obtained at a high speed by use of a fluid stuffing nozzle of this type.

It is desirable to have the relaxation percentage of 10% or more as a result of the relaxed heat set treatment conducted by use of a heated fluid nozzle, more desirably between 10% or more and 40% or less. The reason is that, the degree of stretchability varies greatly depending upon the relaxation percentage determined at the time of relaxed heat set treatment and therefore it is desirable to adjust the relaxation percentage within the abovementioned range in order to obtain a stretch yarn having the desired degree of stretchability (elastic stretchability). When the relaxation percentage obtained at this time is less than 10%, the degree of stretchability will be low and the resulting crimped stretch yarn will tend to the loss of desirable stretchability. The said relaxation percentage is determined by the following equation:

$$\text{Relaxation percentage (\%)} = \frac{\left(\begin{array}{c}\text{Running speed}\\ \text{of yarn before}\\ \text{passing heated}\\ \text{fluid nozzle}\end{array}\right) - \left(\begin{array}{c}\text{Running speed}\\ \text{of yarn after}\\ \text{passing heated}\\ \text{fluid nozzle}\end{array}\right)}{\left(\begin{array}{c}\text{Running speed of yarn before}\\ \text{passing heated fluid nozzle}\end{array}\right)} \times 100$$

As for the processes of drawing and heat treatment, any of so-called separate drawing methods in which spinning and drawing are conducted in independent processes and so-called spin-drawing methods in which spinning and drawing are conducted continuously can be followed. Also, so-called DTY method in which processes of drawing and relaxed heat set treatment are conducted continuously and so-called SDTY method in which all processes of spinning, drawing, and relaxed heat set treatment are conducted continuously can be followed. Any of these methods may be optionally adopted.

As explained in the above, the conjugate filamentary yarn of the present invention is composite spun from a component of thermoplastic elastomer and a component of polyamide or polyester arranged in a specific relationship, whereby both the stretchability arising from crimp and rubber-like elasticity are utilized to make an excellent crimped stretch conjugate yarn which shows high elastic recovery percentage of elongation and high degree of stretchability when highly elongated, which have never been seen with conventional stretch yarns. Therefore, it is very useful for the preparation of panty hose and other woven and knitted fabrics.

Incidentally, there occurres a reversal point $r_P$ regarding the direction with a component P as shown in FIG. 7, which the states of filament at a changing degree of stretch. However, this causes no trouble in actual use.

The present invention is described in detail by the following examples. The hardness of an elastomer component, elongation of crimp (EL) and rubber-like elasticity (RE), total crimp (TC) and shrinkage of boiling-off water treatment (FS), and elongation recovery (ER), used in the examples, were measured according to the following methods.

(1) Hardness:

According to JIS K-6301.

(2) Elongation of crimp (EL), rubber-like elasticity (RE):

A skein of a yarn, either drawn or relaxed by heat treatment after drawing, was weighted with an initial load of 2 mg/de, subjected to the crimping process in boiling water for 20 minutes, and dried naturally for 24 hours still under the initial load. The crimped yarn thus obtained was set on the tensile tester of Tensilon III type and the evaluation was made by inspecting the specimen with the use of a cathetometer of 20 magnifications. The test was started under the conditions: the length of the specimen, 20 cm; initial load, 2 mg/de; elongation speed, 100%/min., and chart speed, 20 cm/min., with the cathetometer focused on the 10-cm middle part of the specimen. During the inspection, a state of the specimen shown in FIG. 7, was observed at the initial stage, and the crimp was gradually stretched and soon reached a state as shown in FIG. 8. A mark was put to indicate how far the specimen was elongated. The elongation obtained so far was the elongation arising from crimp. When further stretched, the specimen reached a state as shown in FIG. 9. The stretch between FIG. 8 and FIG. 9, was rubber-like elasticity. The result of the determination was obtained from the average value of 5 measurements.

(3) Total crimp (TC) and shrinkage of boiling-off water treatment (FS):

A skein was prepared from a yarn which has been subjected to a relaxed heat set treatment and weighted with an initial load of 2 mg/de and the length ($l_0$) of the skein was measured. Without removing the initial load, the yarn was subjected to a crimping treatment for 20 minutes in boiling water and dried naturally of 24 hours under the load. The load was increased to a total of 200 mg/de and 1 minute later the length ($l_1$) of the skein was measured. Then the load was removed and the skein was weighted again with the initial load. 1 minute later the length ($l_2$) was measured. Total crimp (TC) and shrinkage of boiling-off water treatment (FS) were calculated by the following equations respectively.

$$\text{Total crimp } (TC)(\%) = \frac{l_1 - l_2}{l_0} \times 100$$

$$\text{Shrinkage of boiling-off water treatment } (FS)(\%) = \frac{l_0 - l_1}{l_0} \times 100$$

(4) Elongation recovery (ER):

A skein was prepared from a yarn which had been subjected to a heat treatment, weighted with an initial load of 2 mg/de, subjected to a crimping process for 20 minutes in boiling water, and dried naturally for 24 hours without removing the initial load. The elongation recovery (ER) was determined with thus prepared specimen under temperature of 20°±2° C. and relative humidity of 65±2% by hanging the yarn as follows:

(a) Length of specimen yarn: 200 mm (length $l_0$ of yarn under initial load)
(b) Initial load: 2 mg/de
(c) Test load: 1000 mg/de
(d) Time under load: 3 minutes
(e) Measurement of yarn length $l_1$ under test load, removal of test load and weighting of yarn with initial load.
(f) Residual length $l_2$ of yarn was measured when 3 minutes had passed after initial load was placed.
(g) Elongation recovery was calculated according to the following equation:

$$\text{Elongation recovery } (ER)(\%) = \frac{\text{Length of yarn recovered from elongation } (l_1 - l_2)}{\text{Length of yarn under load of 1000 mg/de after initial length } (l_1 - l_0)} \times 100$$

EXAMPLE 1

Nylon 6 having the intrinsic viscosity [η] of 1.1 and commercially available thermoplastic polyurethane Elastollan E595 (capro type) having the hardness of 95 (manufactured by Nippon Elastollan Co., Ltd) which was to make an elastomer component were melted separately at 247° C. and 228° C. and conjugate melt spun with the use of a spinneret of side-by-side type as shown in FIG. 12, or spinneret of eccentric sheath-core type as described in the gazette of Japanese Patent Publication No. 27175/80, heated at 240° C. The area ratio EA/PA between the elastomer component and polyamide component on the cross section of the conjugate filament was varied by adjusting the extrusion ratio between the two component by means of the respective gear pumps. Also (b/a) and $\overline{EiPi}$ were varied by changing HE, HP, l and θ of the spinneret shown in FIG. 12. The conjugate yarn was taken up as undrawn yarn at the take up speed of 500 m/min. while applying 0.6% of silicone oil. After that the yarn was drawn separately in a drawing process and made to have elongation at break of 30% to 40%. The elongation of crimp (EL) and rubber-like elasticity of the drawn yarn were determined and the results are shown in Table 1, Nos. 2–9, No. 11 and Nos. 13–14.

The same determination was conducted with conjugate filament having a structure as shown in FIG. 4, prepared by use of a spinneret of side-by-side type described in the gazette of Japanese Patent Publication No. 20247/68 and the result is also shown in Table 1, No. 1.

Furthermore, the result obtained with a conjugate filamentary yarn prepared from an elastomer component comprising commercially available Elastomer Diamide×3978 of polyamide type having the hardness of 97 manufactured by Daicel Chemical Industries Ltd and another component comprising polyethylene terephthalate, [η] 0.65, modified with 2.7 mole % of 5-sodium sulfoisophthalate under the conditions of Table 1, No. 3 is shown in No. 10 of the same table and another result obtained with a conjugate filamentary yarn prepared from an elastomer component comprising said Elastomer Diamide×3978 of polyamide type and another component comprising polybutylene terephthalate, [η] 0.87, modified with 2.1 mole % of 5-sodium sulfoisophthalate under the conditions of Table 1, No. 3 is shown in No. 12.

TABLE 1

| Run No. | Cross section of a filament | $\frac{b}{a}$ | EA/PA | $\frac{}{EiPi}$ | EL (%) | RE (%) |
|---|---|---|---|---|---|---|
| *1 | FIG. 2, (a) | 1 | 1 | 0.7a | 69 | 4 |
| *2 | FIG. 1, (a) | 1.1 | 1 | 0.7a | 71 | 5 |
| 3 | FIG. 1, (a) | 1.4 | 1 | 0.6a | 73 | 28 |
| 4 | FIG. 1, (a) | 3.8 | 1 | 1.6a | 25 | 29 |
| *5 | FIG. 1, (a) | 4.2 | 1 | 2.1a | 7 | 16 |
| 6 | FIG. 1, (a) | 1.6 | 2.2 | 1.2a | 83 | 46 |
| 7 | FIG. 1, (a) | 1.5 | 0.45 | 1.3a | 64 | 33 |
| *8 | FIG. 1, (a) | 1.4 | 0.40 | 1.1a | 31 | 3 |
| *9 | FIG. 1, (a) | 1.3 | 1 | 0.4a | 83 | 3 |
| 10 | FIG. 1, (a) | 1.5 | 1 | 0.7a | 65 | 24 |
| *11 | FIG. 1, (a) | 1.7 | 2.5 | 1.1a | 49 | 7 |
| 12 | FIG. 1, (a) | 1.5 | 1 | 0.7a | 59 | 22 |
| 13 | FIG. 1, (c) | 1.4 | 1 | 0.6a | 66 | 25 |
| 14 | FIG. 1, (b) | 1.5 | 1 | 0.6a | 70 | 26 |

*Comparison

The specimens which satisfied the conditions specified by the present invention had both elongation of crimp (EL) and rubber-like elasticity (RE) of 20% or more and showed an excellent stretchability but those other than the present invention especially showed a smaller rubber-like elasticity and failed to show a powerful stretchability.

EXAMPLE 2

Nylon 6 having the intrinsic viscosity [η] of 1.1 (determined by use of m-cresol solution at 30° C.) and a polyurethane component comprising commercially available thermoplastic polyurethane Elastollan E595 (capro type) having the hardness of 95 and another polyurethane component comprising Elastollan E995 (carbonate type) having the hardness of 95 (both manufactured by Nippon Elastollan Co., Ltd.) were used to prepare respective conjugate filamentary yarns. Nylon 6 was melted at 247° C., polyurethane E595 at 228° C., and E995 at 230° C. separately and were made into two kinds of conjugate filamentary yarns respectively with the use of a spinneret of side-by-side type heated at 245° C. as shown in FIG. 12. The area ratio EA/PA between the polyurethane component and the polyamide component was made to 1 by adjusting the respective extrusion ratios between the components. The cross section of the respective filaments was made to take the shape of FIG. 1, and a/b was made to be 1.5 by adjusting l and θ of the spinneret of FIG. 12. 0.6% by weight of silicone oil was applied to the obtained melt spun yarns and undrawn yarns of 700 denier/12 filaments were obtained.

Thus obtained undrawn yarn was once taken up and was then subjected to the DTY process, wherein drawing and relaxed heat set treatment were combined in continuance, or the yarn was, without being taken up, directly subjected to the SDTY process where spinning was followed by drawing and relaxed heat set treatment, to be put to the test. The drawing is so conducted as to give an elongation at break of 25 to 35% to the drawn yarn. After having been heat treated at varied temperature, the yarn was led to the heated compressed air nozzle as described in FIG. 1 of the specification of U.S. Pat. No. 4,188,691, wherein temperature of the compressed air and relaxation rate were varied under the constant pressure of the compressed air kept at 1.0 kg/cm$^2$G. In Table 2, the conditions of drawing and texturing, and physical properties of the obtained crimped stretch yarns are shown.

The results of the test conducted for the filament prepared to have a structure of FIG. 4, by use of an ordinary spinneret of side-by-side type described in the gazette of Japanese Patent Publication No. 20247/68, are also shown in Table 2.

TABLE 2

| | Spinning and drawing conditions | | | | | | Texturing conditions | | Properties of crimped yarns | | | | |
|---|---|---|---|---|---|---|---|---|---|---|---|---|---|
| Run No. | Cross section of a filament | Kind of polyurethane | Texturing method | Spinning speed (m/min.) | Drawing speed (m/min.) | Heat treating temperature after drawing (°C.) | Temperature of heated compressed air (°C.) | Relaxation (%) | TC (%) | FS (%) | EL (%) | RE (%) | ER (%) |
| 15 | FIG. 1, (a) | E595 | DTY | 500 | 1000 | Room temperature | 80 | 30 | 40 | 19 | 118 | 52 | 86 |
| 16 | " | E995 | " | " | " | Room temperature | 100 | " | 43 | 21 | 125 | 80 | 89 |
| 17 | " | " | " | " | " | 80 | " | " | 41 | 20 | 102 | 58 | 88 |
| 18 | " | " | " | " | " | 120 | " | " | 37 | 17 | 85 | 37 | 84 |
| 19 | " | " | " | " | " | 130 | " | " | 33 | 15 | 65 | 20 | 80 |
| 20 | " | " | " | " | " | Room temperature | 60 | " | 44 | 25 | 112 | 75 | 88 |
| 21 | " | " | SDTY | " | 2000 | Room temperature | 80 | " | 43 | 22 | 125 | 75 | 88 |
| 22 | " | " | " | " | " | Room temperature | 100 | " | 43 | 21 | 125 | 80 | 89 |
| 23 | " | " | " | " | " | Room temperature | 150 | " | 41 | 18 | 85 | 35 | 84 |
| 24 | " | " | DTY | " | 1000 | Room temperature | 160 | " | 39 | 16 | 70 | 20 | 79 |
| 25 | " | " | " | " | " | Room temperature | 100 | 5 | 34 | 19 | 74 | 24 | 80 |
| 26 | " | " | " | " | " | Room temperature | " | 10 | 36 | 20 | 90 | 40 | 83 |
| 27 | " | " | " | " | " | Room temperature | " | 20 | 40 | 21 | 106 | 60 | 86 |
| *28 | FIG. 2, (a) | " | " | " | " | Room | " | 30 | 37 | 18 | 125 | 6 | 67 |

TABLE 2-continued

| Run No. | Spinning and drawing conditions: Cross section of a filament | Kind of polyurethane | Texturing method | Spinning speed (m/min.) | Drawing speed (m/min.) | Heat treating temperature after drawing (°C.) | Texturing conditions: Temperature of heated compressed air (°C.) | Relaxation (%) | Properties of crimped yarns: TC (%) | FS (%) | EL (%) | RE (%) | ER (%) |
|---|---|---|---|---|---|---|---|---|---|---|---|---|---|
| | | | | | | temperature | | | | | | | |

*Comparison

As seen from Table 2, those specimens in Nos. 15 to 18, 21 to 23, 26 and 27, wherein the optimum conditions mentioned before were statisfied, showed the elongation of crimp (EL) of 85 to 125% and rubber-like elasticity (RE) of 35 to 80%, making a considerably great total of 120 to 200%. The elongation recovery (ER) under load of 1.0 g/de was more than 80%, showing excellent stretchability and recoverableness to provide stretch yarns which would not raise any problem as to the dimensional stability. In contrast to the preceding specimens, Nos. 19 and 24 where the temperature of post-drawing heat treatment was beyond the range of room temperature and 120° C. or the temperature of heated compressed air was beyond the range of 80° and 150° C. and No. 25 where the relaxation percentage was less than 10%, showed a good shrinkage of boiling-off water treatment (FS) but the elongation of crimp (EL) and rubber-like elasticity (RE) were both low and the elongation recovery (ER) was below 80%.

No. 20, in which the temperature of heated compressed air was low, showed a good elongation of crimp (EL) and rubber-like elasticity (RE) but the obtained stretch yarn tended to show unsatisfactory dimensional stability because of its high shrinkage of boiling-off water treatment reading 25%.

Further, a conjugate stretch filament of No. 28, which was prepared in a side-by-side arrangement whose cross section was formed like FIG. 4, failed to exhibit a satisfactory screw structure when it was stretched. The yarn accordingly had only a slight degree of rubber-like elasticity and did not have powerful stretchability.

I claim:

1. A conjugate filamentary yarn, characterized in that each of the individual constituents whose cross-sectional view presents a compressed flat figure, which comprises an elastomeric thermoplastic elastomer and a non-elastomeric polyamide or a polyester, wherein the respective components are arranged in such a way as to satisfy the following formulas (I) to (III) simultaneously:

$$4 \geqq \frac{b}{a} \geqq 1.2 \quad \text{(I)}$$

$$2.3 \geqq \frac{EA}{PA} \geqq 0.43 \quad \text{(II)}$$

-continued $$\overline{EiPi} \geqq \frac{a}{2} \quad \text{(III)}$$

where a indicates the length of the minor axis which passes the centroid on the cross section of the filament; b, the length of the major axis which passes the centroid on the cross section of the filament; EA, the area occupied by the thermoplastic elastomer on the cross section of the filament; PA, the area occupied by non-elastomeric polyamide or polyester on the cross section of the filament; and $\overline{EiPi}$, the distance between the centroid Ei of the thermoplastic elastomer component on the cross section of the filament and the centroid Pi of the non-elastomeric polyamide or polyester component.

2. A conjugate filamentary yarn according to claim 1, wherein the cross section of the filament takes the shape of a cocoon.

3. A conjugate filamentary yarn according to claim 1, wherein the cross section of the filament takes the shape of an oval.

4. A conjugate filamentary yarn according to claim 1, wherin the centroid of said thermoplastic elastomer (Ei) and the centroid of said non-elastomeric polyamide or polyester (Pi) are located on the major axis which passes the centroid i on the cross section of the filament.

5. A conjugate filamentary yarn according to claim 1, wherein said filament is prepared in a side-by-side arrangement.

6. A conjugate filamentary yarn according to claim 1, wherein said filament is prepared in an eccentric sheath-core arrangement.

7. A conjugate filamentary yarn according to claim 1, wherein the hardness of said thermoplastic elastomer (measured according to JIS K-6301) is within the range of 90 to 100.

8. A conjugate filamentary yarn according to claim 1, wherein said thermoplastic elastomer is elastomer of the polyurethane type.

9. A conjugate filamentary yarn according to claim 1, wherein said thermoplastic elastomer is elastomer of the polyamide type.

10. A conjugate filamentary yarn according to claim 1, wherein said non-elastomeric polyamide is nylon 6.

11. A conjugate filamentary yarn according to claim 1, wherein said non-elastomeric polyester is polyethylene terephthalate or polybutylene terephthalate.

12. A conjugate filamentary yarn according to claim 11, wherein said non-elastomeric polyester is a polyester which is copolymerized with 5-sodium isophthalic acid.

* * * * *